US005816444A

United States Patent [19]

David

[11] Patent Number: 5,816,444

[45] Date of Patent: Oct. 6, 1998

[54] ROTOR AND RATCHET ASSEMBLY

[75] Inventor: James C. David, Bakersfield, Calif.

[73] Assignee: Calico Light Weapon Systems, Bakersfield, Calif.

[21] Appl. No.: 546,957

[22] Filed: Oct. 23, 1995

[51] Int. Cl.[6] ..... B65G 59/00

[52] U.S. Cl. ..... 221/289; 89/33.02; 42/49.01

[58] Field of Search ..... 221/289, 277, 221/105, 119; 42/49.01; 89/33.02, 34

[56] References Cited

U.S. PATENT DOCUMENTS

| | | | |
|---|---|---|---|
| 84,685 | 12/1868 | Evans . | |
| 213,555 | 3/1879 | Evans . | |
| 1,285,263 | 11/1918 | Lohne . | |
| 2,087,555 | 7/1937 | Simpson | 273/142 |
| 2,597,798 | 5/1952 | Houplain | 192/8 |
| 3,024,884 | 3/1962 | Sieber | 192/8 |
| 3,051,282 | 8/1962 | Greene | 192/8 |
| 3,088,378 | 5/1963 | Boudreau | 89/161 |
| 3,427,923 | 2/1969 | Meyer et al. | 89/33 |
| 3,976,172 | 8/1976 | F'Geppert | 192/8 |
| 4,034,644 | 7/1977 | Hupp et al. | 89/33 BA |
| 4,166,408 | 9/1979 | Wetzel et al. | 89/33 D |
| 4,384,508 | 5/1983 | Sullivan et al. | 89/33 D |
| 4,676,137 | 6/1987 | Stockton et al. | 89/33.02 |
| 4,738,183 | 4/1988 | Miller et al. | 89/34 |
| 4,766,800 | 8/1988 | Miller et al. | 89/33.02 |
| 4,819,609 | 4/1989 | Tippman | 124/72 |
| 4,888,898 | 12/1989 | Miller et al. | 42/49.01 |
| 4,945,664 | 8/1990 | Miller et al. | 42/49.01 |
| 4,947,572 | 8/1990 | Miller et al. | 42/49.01 |
| 4,962,604 | 10/1990 | Miller et al. | 42/49.01 |
| 4,965,951 | 10/1990 | Miller et al. | 42/49.01 |
| 5,097,816 | 3/1992 | Miller | 124/49 |
| 5,166,457 | 11/1992 | Lorenzetti | 42/49.01 |
| 5,335,579 | 8/1994 | David | 89/34 |

FOREIGN PATENT DOCUMENTS

| | | |
|---|---|---|
| 2010554 | 8/1976 | Germany . |
| 3809319 | 9/1989 | Germany . |

*Primary Examiner*—Kenneth Noland
*Attorney, Agent, or Firm*—Oliff & Berridge, PLC

[57] ABSTRACT

A reciprocating rotor and ratchet assembly wherein the rotor is indexed a certain angle of rotation with each reciprocation of the ratchet member. The assembly includes a housing, the rotor and the ratchet member. The rotor and ratchet member are rotatably located within the housing. The ratchet member includes at least one locking lug and is rotatable between first and second positions relative to housing. The locking lug engages the rotor when the locking lug is rotated in a first direction from the first position to the second position, and causes the rotor to rotate with the locking lug. The locking lug engages the housing when the ratchet member is in the second position and, in this position, the housing maintains the ratchet member in engagement with the rotor in a manner to stop rotation of the rotor. The locking lug disengages the housing and the rotor when the ratchet is rotated in a second direction from the second position in the first direction, such that the rotor remains stationary during this movement.

49 Claims, 7 Drawing Sheets

ROTOR AND RATCHET ASSEMBLY

FIELD OF THE INVENTION

This invention relates to rotor and ratchet assemblies wherein the ratchet assembly causes the rotation of the rotor and indexes the rotor to various predetermined positions. More specifically, this invention relates to a rotor and ratchet assembly wherein the ratchet assembly includes a reciprocating ratchet and the reciprocation of the ratchet causes the rotor to progress a predetermined angle of rotation during each stroke of the ratchet assembly.

BACKGROUND OF THE INVENTION

Ratchet assemblies are commonly employed to drive or otherwise impart rotary movement on a rotor, drum or other rotatable element of an assembly. Often, a rotor assembly, a rotating drum assembly, or any other assembly including a rotating member includes a brake mechanism which either automatically brakes the rotating member when the rotating member is at or above a predetermined speed or which can be employed by an operator or computer to slow or stop the rotating or driven member. Such braking mechanisms frequently employ weights attached to the rotating member which, when subjected to a predetermined centrifugal force, engage the housing or another member of the assembly to brake the rotating or driven member.

Examples of these types of brake mechanisms are disclosed in U.S. Pat. No. 2,087,555 issued to C. G. Simpson on Jul. 20, 1937, U.S. Pat. No. 2,597,798 issued to R. D. Houplain on May 20, 1952, U.S. Pat. No. 3,024,884 issued to Sieber on Mar. 13, 1962, U.S. Pat. No. 3,051,282 issued to W. E. Greene on Aug. 28, 1962 and U.S. Pat. No. 3,976,172 issued to F'Geppert on Aug. 24, 1976.

While these prior art brake mechanisms for rotating or driven members disclosed by these patents may be sufficient for the specific functions and purposes set forth in the respective patents, these brake mechanisms do not have universal applications. For example, the brake mechanisms disclosed by these patents may not precisely function to index a rotor or rotating drum at specific angles of rotation or circumferential distances, as may be desired for particular applications. Moreover, the brake mechanisms disclosed in the cited patents may not perform the intended functions as effectively and efficiently as possible.

One particular application of a rotor and ratchet assembly which may require a braking mechanism is a rotor and ratchet assembly employed in a dispenser which dispenses items at a high speed from a magazine or other housing to another mechanism which may utilize the dispensed items. One example of this application is a high speed magazine for a rapid fire gun. In such applications, it is advantageous for the rotor of the magazine to advance a set angle of rotation or circumferential distance each time the dispenser is employed, e.g., the gun is activated, so that another item may be discharged from the dispenser each time the ratchet assembly operates.

A common design for a high speed magazine of this type is for the magazine to include an outer housing with interior helical feed members which interact with a rotating center rotor to discharge the projectiles, carried by the center rotor, from the magazine. This design is conventional for magazines employed with firearms.

These conventional magazines for firearms are designed primarily for use with conventional bullets and thus, most are not designed to handle delicate projectiles. Stated differently, most of these conventional magazines place relatively large forces on the projectiles contained therein and thus, must be used with durable projectiles only. Such magazines are not suitable for use with air guns and pellets or paint balls which are relatively fragile. For example, some of these conventional magazines rely on gravity and pressure or a belt system to feed the projectiles from the magazine into the gun. Such systems will damage more delicate projectiles such as pellets and paint balls.

Examples of these conventional magazines are disclosed in U.S. Pat. No. 213,555 issued on Mar. 25, 1879 to Evans; U.S. Pat. No. 84,685 issued on Dec. 8, 1868 to Evans; U.S. Pat. No. 1,285,263 issued on Nov. 19, 1918 to Lohne; U.S. Pat. No. 3,088,378 issued on May 7, 1963 to Boudreau; U.S. Pat. No. 3,427,923 issued on Feb. 18, 1969 to Meyer et al.; U.S. Pat. No. 4,034,644 issued on Jul. 12, 1977 to Hupp et al.; U.S. Pat. No. 4,166,408 issued on Sep. 4, 1979 to Wetzel et al.; U.S. Pat. No. 4,384,508 issued on May 24, 1983 to Sullivan et al.; U.S. Pat. No. 4,676,137 issued on Jun. 30, 1987 to Stockton et al.; U.S. Pat. No. 4,738,183 issued on Apr. 19, 1988 to Miller et al.; U.S. Pat. No. 4,766,800 issued on Aug. 30, 1988 to Miller et al.; U.S. Pat. No. 4,888,898 issued on Dec. 26, 1989 to Miller et al.; U.S. Pat. No. 4,945,664 issued on Aug. 7, 1990 to Miller et al.; U.S. Pat. No. 4,947,572 issued on Aug. 14, 1990 to Miller et al.; U.S. Pat. No. 4,962,604 issued on Oct. 16, 1992 to Miller et al.; U.S. Pat. No. 4,965,951 issued on Oct. 30, 1990 to Miller et al.; and West German Patent Nos. 2,010,554 and 3,809,319.

Other magazines have been developed for use with air guns and delicate projectiles such as pellets or paint balls. However, these magazines also have several disadvantages. For example, some of these magazines depend on gravity to feed the projectiles into the gun. Others of these magazines use a complicated belt arrangement which is not practical for air gun pellets. Still others of these magazines are unreliable and easily damaged.

Examples of magazines designed for use with pellets and paint balls are disclosed in U.S. Pat. No. 4,819,609 issued Apr. 11, 1989 to Tippman, U.S. Pat. No. 5,097,816 issued Mar. 24, 1992 to Miller and U.S. Pat. No. 5,166,457 issued Nov. 24, 1992 to Lorenzetti.

In view of the above, it is clear that there is a need for a rotor and ratchet assembly, wherein the ratchet assembly drives the rotor, which (1) includes a mechanism for stopping or indexing the rotor at set angles of rotation or circumferential distances and (2) can be used in many environments including dispensers of delicate items. Such rotor and ratchet assemblies should be capable of precisely indexing or stopping the rotor after a set angle of rotation or a set circumferential distance. None of the above-identified prior art patents disclose rotor and ratchet assemblies, any type of rotating drum assembly or any other mechanism including a rotating member which have these capabilities.

A prior patent which addresses this need as to an improved helical indexing magazine for firearms is U.S. Pat. No. 5,335,579 issued on Aug. 9, 1994 to David and a patent application which addresses this need is U.S. patent application Ser. No. 08/222,266 filed on Apr. 4, 1994 by David, now U.S. Pat. No. 5,520,171. However, the mechanisms disclosed by this patent and application may not be employed in some environments which require a braking mechanism for a rotor, rotating drum or other rotating element of an assembly, or may not be effective or efficient in such environments. Further, in these mechanisms, the braking assembly is not directly associated with the ratchet assembly. Rather, the braking system interacts with the rotor only.

Thus, even considering this patent and application, there is a need in the art for a ratchet and rotor assembly which in turn has universal applications, including the handling of delicate items, and for which the brake mechanism is an integral part of the ratchet assembly.

This invention addresses these needs in the art, along with other needs which will become apparent to those skilled in the art once given this disclosure.

SUMMARY OF THE INVENTION

This invention provides a rotor and ratchet assembly including a housing, a rotor rotatably located within the housing and a ratchet member also rotatably located within the housing. The ratchet member includes at least one locking lug and is rotatable between first and second positions relative to the housing. The locking lug engages the rotor when the locking lug is rotated in a first direction from the first position to the second position and causes the rotor to rotate with the locking lug. The locking lug also engages the housing when the ratchet member is in the second position and the housing maintains the ratchet member in engagement with the rotor when the ratchet member is in the second position to stop rotation of the rotor. The locking lug disengages the rotor when the ratchet is rotated in a second direction from the second position to the first position.

In certain embodiments of this invention, the ratchet member also includes a cross arm. The locking lug is rotatably attached to the cross arm. The cross arm may be an elongated member. The locking lug may be rotatably attached to one end of the cross arm.

In certain other embodiments, the locking lug includes a head portion that in turn includes an outer edge portion which engages the housing and an inner edge portion which engages the rotor. The locking lug may also include an elongated arm portion having two ends. A first end of the arm portion may be rotatably attached to the cross member. The head portion may be located at the second end.

In further embodiments, the rotor includes a plurality of parallel flutes. The flutes are engaged by the locking lug. The flutes may have notches which are engaged by the inner edge portion of the head portion of the locking lug.

In yet other embodiments, the head portion may include an inner surface adjacent to the inner edge portion. When the ratchet member is in its second position, the next flute after the flute engaged by the locking lug may engage the inner surface to stop the rotor.

In certain other embodiments, the housing includes a bulkhead which extends inwardly into the housing. The head portion engages the bulkhead when the locking lug is in the second position and maintains the locking lug in contact with the rotor when the locking lug is in the second position. The housing may include two bulkheads and the ratchet member may include two locking lugs. The two bulkheads and the two locking lugs may be diametrically opposed.

In the embodiments in this invention directed to an indexing dispenser for storing and dispensing a plurality of items to another member, such as a gun magazine, the embodiments include a housing, a drive member, a release member, a ratchet member and a camming member. The housing has a first end and a second end and a passageway which extends from the first end to the second end along a longitudinal axis. The housing also includes a helical element on the interior of the housing which extends at least partially from the first end to the second end. The drive member is rotatably coupled within the housing and has a plurality of flutes for guiding the items along the helical element. The release member is coupled to the housing and guides the dispensed items from the housing into the other member. The ratchet member is rotatably located within the housing and includes at least one locking lug. The ratchet member is rotatable between first and second positions relative to the housing. The locking lug engages the drive member when the locking lug is rotated in a first direction from the first position to the second position and causes the drive member to rotate with the locking lug. The locking lug engages the housing when the ratchet member is in the second position and the housing maintains the ratchet member in engagement with the drive member when the ratchet member is in the second position in a manner to stop rotation of the drive member. The locking lug disengages the housing and the drive member when the ratchet is rotated in a second direction from the second position to the first position.

The rotor and ratchet assemblies according to this invention have many advantages over the prior assemblies which perform the same function, including at least the following. One advantage of the rotor and ratchet assemblies of this invention is that the assemblies precisely move the rotor the desired angular rotation or circumferential distance. Another advantage is that the drive mechanism and brake mechanism of these assemblies are integral and self-contained.

A further advantage is that the drive and brake mechanisms of these assemblies inflict minimal wear on the ratchet member and rotor.

Yet another advantage is that the rotor and ratchet assemblies of this invention can be utilized to a wide variety of applications.

A further advantage is that the rotor and ratchet assemblies of this invention can operate at a high speed and thus may be utilized in applications such as in the high speed dispensing of articles.

Another advantage of the rotor and ratchet assemblies of this invention is that the assemblies are relatively easy to manufacture and to assemble since the assemblies have only a few parts.

A further advantage of the rotor and ratchet assemblies according to this invention is that these assemblies are sturdy and resist operator damage.

The embodiments of this invention directed to gun magazines have many further advantages, including that the magazines minimize the force on the projectiles to reduce the risk of damage if fragile projectiles are being employed. Specifically, the helical rib and flutes support and protect the projectiles. These members gently feed the projectiles into the release member.

Other advantages and salient features of the rotor and ratchet assemblies according to this invention will become apparent from this disclosure.

BRIEF DESCRIPTION OF THE DRAWINGS

Referring to the drawings which form a part of this disclosure.

DETAILED DESCRIPTION OF THE INVENTION

Figure 1:
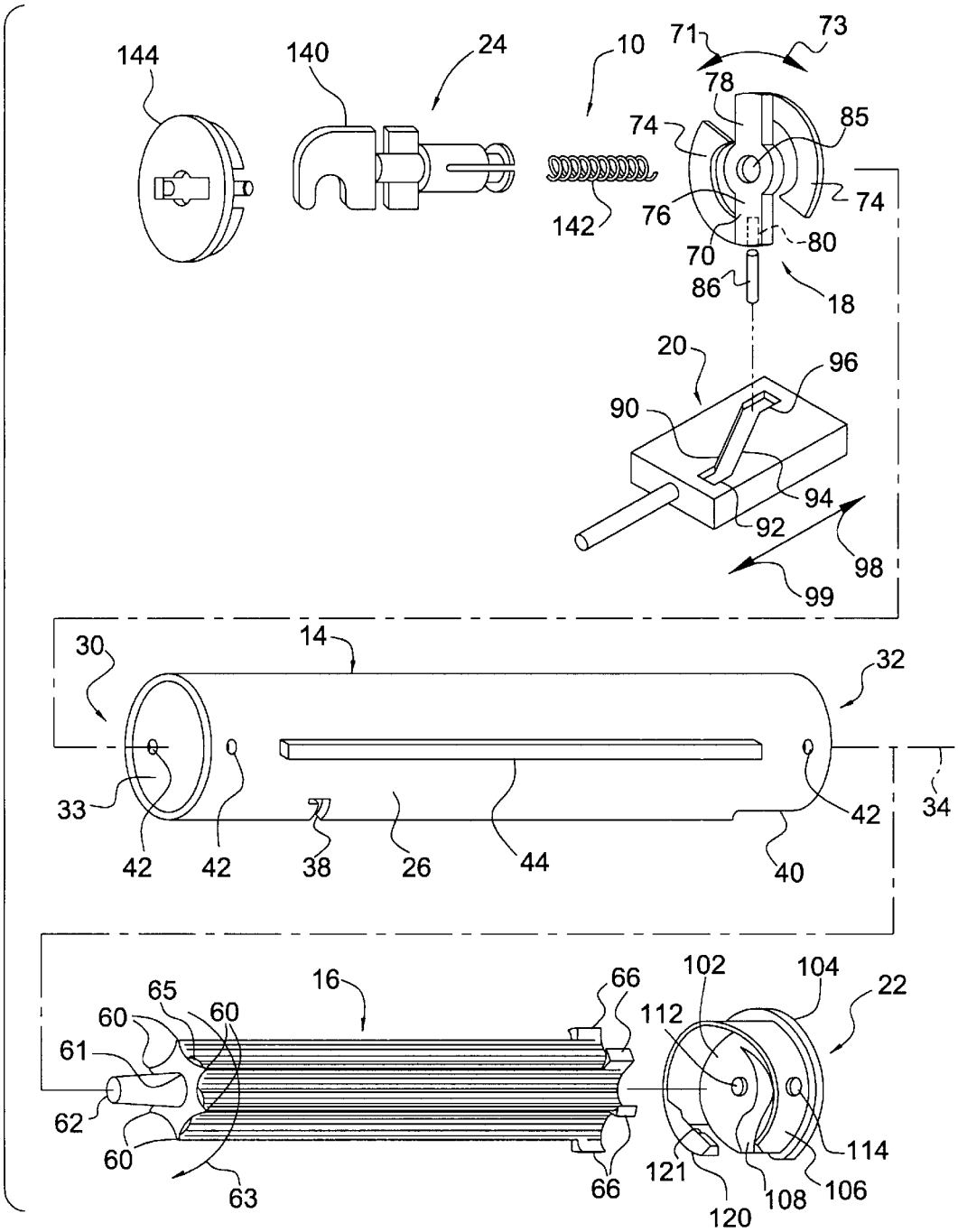
FIG. 1 is an exploded view of an indexing helical magazine which includes the present invention.
Figure 2:
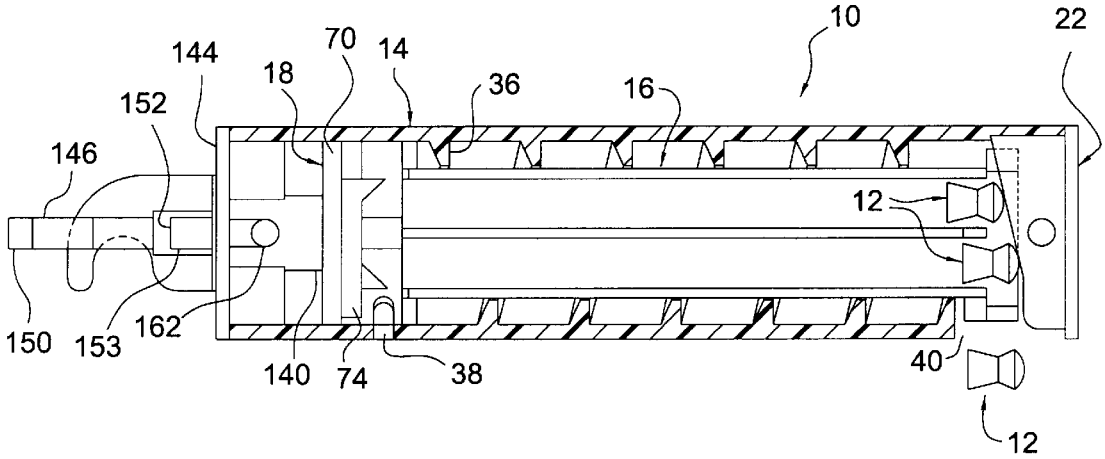
FIG. 2 is a longitudinal cross-sectional view of the cylindrical shell of the housing of the magazine of FIG. 1 with the other parts of the magazine shown in full and with sample pellets added for clarity, and depicting the magazine in the loading position.
Figure 3:
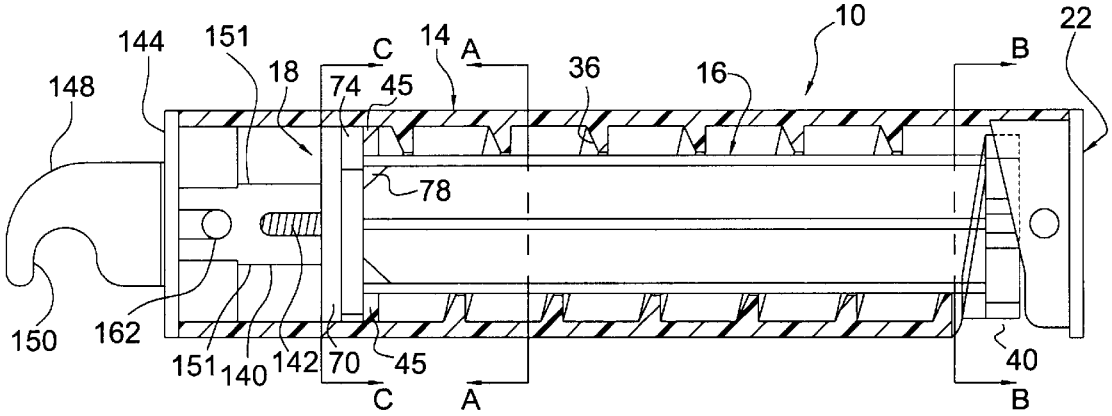
FIG. 3 is a longitudinal cross-sectional view of the cylindrical shell of the housing of the magazine of FIG. 1 with the other parts of the magazine shown in full, and depicting the magazine in the loaded position.
Figure 3A:
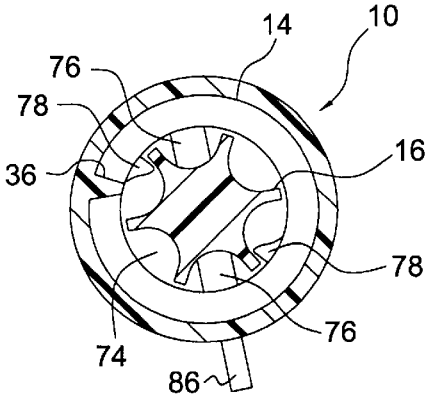
FIG. 3*a* is a transverse cross-sectional view of the magazine of FIGS. 1–3 along line A—A of FIG. 3.

Referring to the Figures, and in particular FIGS. 1–3, a rotor and ratchet assembly according to this invention, comprising rotor 16 and ratchet assembly 18, is illustrated in the environment of an indexing helical magazine also according to this invention, magazine 10.

As discussed above, the rotor and ratchet assemblies of this invention may be employed in any environment which includes a driven rotor, rotating drum or other rotary member. The rotor and ratchet assemblies of this invention have particular application in the orderly dispensing of items carried by a rotor or rotating drum within a housing from the housing. One such specific application is the high speed dispensing of projectiles from a magazine to a firearm. Magazine 10 is one embodiment of this application and is illustrated in the figures and described below. Magazine 10 can be used with any type of projectiles, but has features and advantages which render it particularly useful with an air gun employing fragile projectiles such as pellets or paint balls 12.

In the embodiment of this invention illustrated in the figures, carrier or rotor 16 is substantially cylindrical and includes cylindrical core 61, a plurality of flutes or projections 60, shaft 62, hole 64 and arms 66 (see FIGS. 1 and 9–11). Rotor 16 is rotatably coupled within cylindrical shell 26 of housing 14, as discussed below.

Cylindrical core 61 extends along longitudinal axis 34 of housing 14 (discussed below) when magazine 10 is properly assembled. Shaft 62 extends outwardly from cylindrical core 61 at one end of rotor 16 along longitudinal axis 34 and is cylindrical. Hole 64 is cylindrical and extends partially through the center of cylindrical core 61 at the other end of rotor 16 along longitudinal axis 34.

Preferably, six evenly spaced apart flutes 60 extend outwardly from cylindrical core 61, parallel to longitudinal axis 34. Flutes 60 are designed such that pellets 12 fit individually between adjacent flutes 60. The outermost diameter of flutes 60 is less than the innermost diameter of rib 36 of housing 14 (discussed below) so that rotor 16 can rotate within rib 36. Flutes 60 extend the length of cylindrical core 61.

Figure 10:
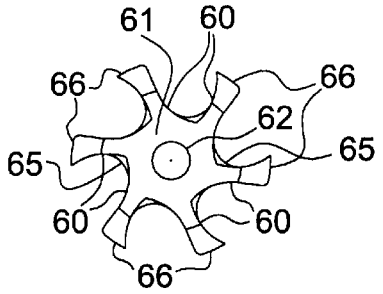
FIG. 10 is a left end view of the carrier or rotor of FIG. 9.
Figure 11:
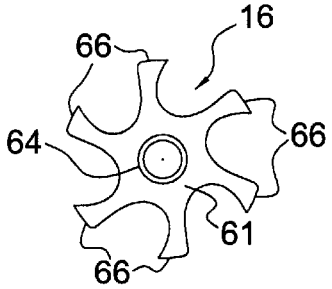
FIG. 11 is a right end view of the carrier or rotor of FIG. 9.

Each flute 60 has a notch 67 therein near the base of the flute with cylindrical core 61 (see FIGS. 1 and 10). Notches 67 are located at the same end of flutes 60 as shaft 62. Notches 67 are designed to be engaged by inner edge portions 79 of lug members 74 (discussed below).

Arms 66 extend outwardly from the outer ends of flutes 60 at the end of cylindrical core 61 opposite shaft 62 (see FIG. 1). The ends of arms 66 are slightly curved in the direction opposite from the direction in which carrier 16 rotates (as depicted by arrow 63 in FIG. 1). The curvature of arms 66 is such that arms 66 protect and guide pellets 12 into end cap 22, as discussed below.

Ratchet or rotating member 18 includes cross arm 70, two lug members 74, pins 72 and pin 86. Cross arm 70 has an enlarged center portion 75, center hole 85 and two arms 76. Arms 76 are integral with enlarged center portion 75 and extend outwardly therefrom, in diametrically opposite directions. Center hole 85 is located at the center of enlarged center portion 75 and receives shaft 62 of rotor 16 therethrough such that cross arm 70 is rotatably received on shaft 62. One of the arms 76 has pivot pin bore 80 therein. Pivot pin bore 80 is cylindrical and is located along the longitudinal axis of arms 76.

One of the lug members 74 is rotatably attached to each arm 76 at the free ends of arms 76 by pins 72. Each lug member 74 includes arm portion 77 and enlarged head 78. One end of arm portion 77 is rotatably attached to an arm 76 of cross arm 70 by a pin 72. Enlarged head 78 is located at the other end of arm portion 77.

Figure 12:
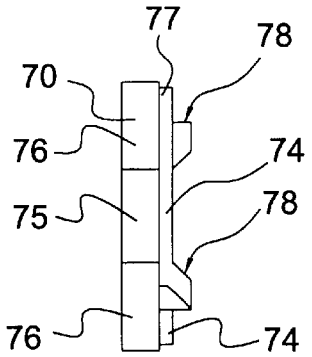
FIG. 12 is a bottom view of the ratchet disk of the magazine of FIG. 1.

Enlarged head 78 has inner edge portion 79 (designed to engage notches 67 in flutes 60), inner surface 81 and outer edge portion 83. Enlarged heads 78 also have a greater width than arm portions 77 so that enlarged heads 78, but not arm portions 77, engage bulkheads 45 (see FIGS. 2, 3 and 12, and as discussed below).

Pivot pin 86 is preferably cylindrical. It is press-fit into bore 80 and extends outwardly from cross arm 70 through L-shaped slot 38 of housing 14 when magazine 10 is properly assembled.

As discussed below, ratchet 18 rotates in a first direction 73 and a second direction 71, see FIG. 1. In fact, in this embodiment, ratchet 18 reciprocates in these two directions through an angle of approximately 60°. Ratchet 18 engages flutes 60 and is rotatably coupled within housing 14 adjacent first end 30 of cylindrical shell 26, as discussed below.

With respect to magazine 10, magazine 10 includes housing 14, carrier or rotor 16, ratchet 18, camming bolt 20, end cap assembly 22, and loading member 24. Magazine 10 is indexed via the interaction of rotor 16, ratchet 18 and camming bolt 20, as discussed in detail below. End cap assembly 22 guides pellets 12 from magazine 10 into a firearm. Pellets 12 are loaded into magazine 10 by loading member 24.

Housing 14, as illustrated in FIGS. 1–3 and 6–8, is generally cylindrical and includes cylindrical shell 26, interior spiral or helical rib 36, flanges 44 and two interior bulkheads 45.

Cylindrical shell 26 has first end 30, second end 32 and longitudinal axis 34. Cylindrical passageway 33 is defined by the inner surface of cylindrical shell 26. Cylindrical shell 26 has L-shaped slot 38 therein adjacent first end 30, cutout 40 therein at second end 32 and a pair of assembly holes 42 therein at each of first end 30 and second end 32 (see FIGS. 1, 6 and 7).

Rib 36 projects into passageway 33 from the interior surface of cylindrical shell 26. In this embodiment, rib 36 extends partially from first end 30 to second end 32 (between L-shaped slot 38 and cut-out 40, see FIG. 6) and spirals toward the second end 32. Rib 36 has a size and curvature such that individual pellets 12 fit relatively snugly between adjacent walls thereof.

Interior bulkheads 45 are walls of consistent width which extend inwardly from the interior surface of cylindrical shell 26, perpendicular to longitudinal axis 34. Interior bulkheads 45 are diametrically opposed and extend partially into cylindrical passageway 33. The innermost surface of interior bulkheads 45 is flat, formed by line segments intersecting cylindrical shell 26. Bulkheads 45 are located adjacent the end of rib 36 which is at first end 30.

Figure 7:
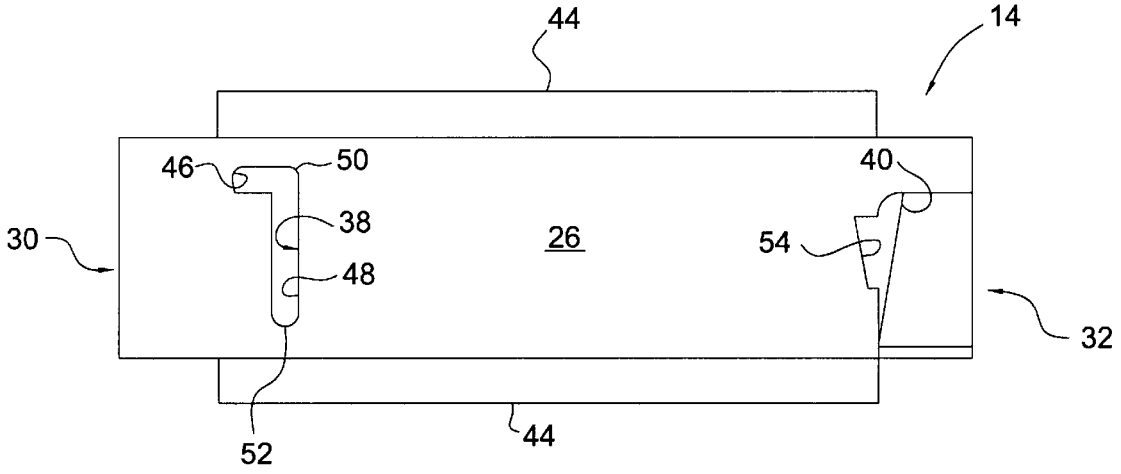
FIG. 7 is a bottom plan view of the cylindrical shell of FIG. 6.
Figure 8:
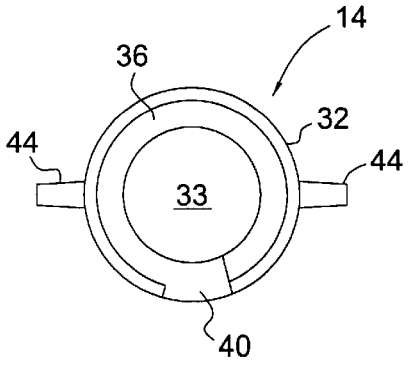
FIG. 8 is a right end view of the cylindrical shell of FIG. 6.
Figure 9:
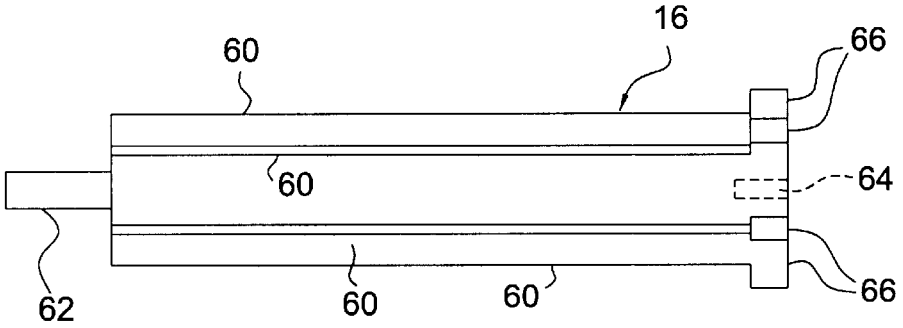
FIG. 9 is a side view of the carrier or rotor of the magazine of FIG. 1.

L-shaped slot 38 has first leg 46 and second leg 48 which intersect at intersection 50 to form an "L", as illustrated in FIG. 7. First leg 46 extends longitudinally in cylindrical shell 26, parallel to longitudinal axis 34. Second leg 48 includes second end 52, opposite intersection 50. From intersection 50, second leg 48 extends perpendicularly to first leg 46 to second end 52. Second leg 48 is longer than first leg 46.

Cut-out 40 is substantially rectangular with an angular portion 54, see FIG. 7.

Assembly holes 42 have the same diameter. Each pair of holes 42 at each end 30 and 32 is diametrically opposed, i.e., spaced 180° apart.

Flanges 44 extend outwardly from the exterior of cylindrical shell 26 parallel to longitudinal axis 34. Flanges 44 are also spaced 180° apart. Each flange 44 extends in line with a pair of assembly holes 42, one at each end of cylindrical shell 26, but is spaced inward from both of these assembly holes 42, see FIG. 1.

Camming bolt 20, as seen in FIG. 1, includes a preferably substantially rectangular shaped groove 90. Groove 90 receives the lower end of pin 72. Camming bolt 20 can take many forms. For instance, it may be a trigger, pump or lever of a gun. When the gun to which magazine 10 is attached is operated, bolt 20 moves translationally and rearwardly toward first end 30 into a first position 98 and forwardly toward second end 32 into a second position 99. Stated differently, bolt 20 reciprocates linearly between positions 98 and 99 as the gun is operated.

Figure 13:
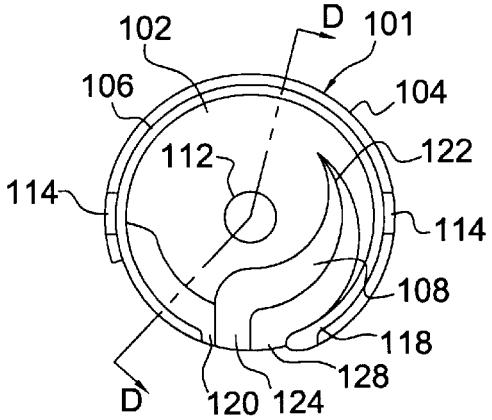
FIG. 13 is a left end view of the plug of the magazine of FIG. 1.
Figure 14:
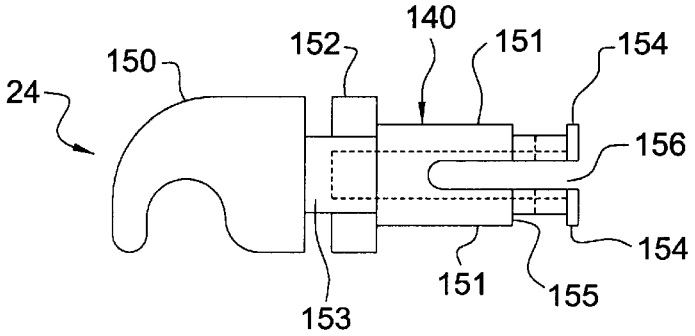
FIG. 14 is a side view of the body of the loading assembly of the magazine of FIG. 1.
Figure 15:
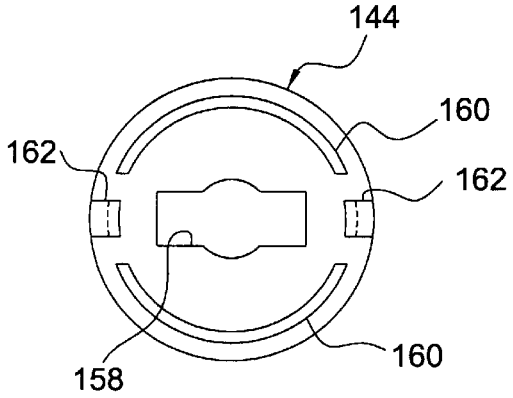
FIG. 15 is a right end view of the end cap of the magazine of FIG. 1.
Figure 16:
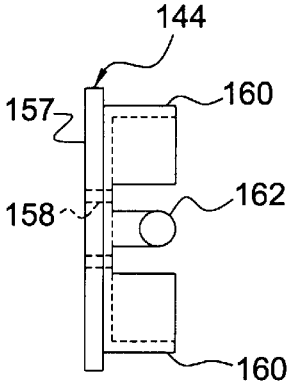
FIG. 16 is a side view of the end cap of FIGS. 1 and 15.
Figure 17:
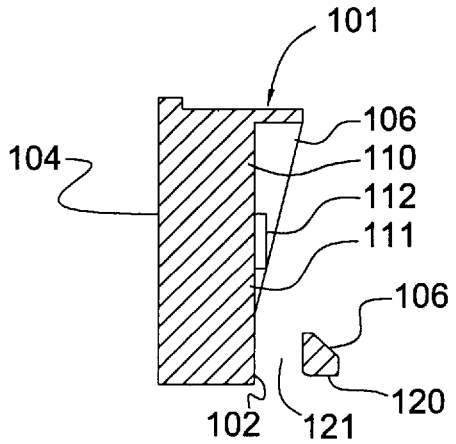
FIG. 17 is a cross-sectional view of the plug illustrated in FIG. 13 along line D—D of FIG. 13.

Second end cap assembly or release member assembly 22 includes plug 101. Plug 101 includes, basically, inner wall 102, outer wall 104, and spiral side wall 106, as illustrated in FIGS. 1, 13 and 17. Plug 101 is substantially cylindrical and is coupled to housing 14 at second end 32 of cylindrical shell 26.

When magazine 10 is properly assembled, inner wall 102 is adjacent flutes 60 and arms 66 of carrier 16. Outer wall 104 forms the exterior end wall at second end 32 of cylindrical shell 26 and is substantially the same diameter as cylindrical shell 26.

Inner wall 102 has feeding groove 108 and plug 112 extending inwardly. Feeding groove 108 has a beginning point 122 and an end point 124. Feeding groove 108 extends into inner wall 102 and, in this embodiment, is shaped triangularly in cross section. Feeding groove 108 begins at beginning point 122 and continuously deepens as it extends arcuately to its end point 124. End point 124 aligns with cut-out 40 of housing 14 when magazine 10 is properly assembled.

Spiral side wall or flange 106 includes first end 118 and second end 120. Spiral side wall 106 spirals outwardly from its lowest height at inner wall 102 at its first end 118 to its greatest height at second end 120. Spiral side wall 106 has a diameter slightly smaller than the internal diameter of cylindrical shell 26 so that end cap assembly 22 is received within shell 26. Thus, spiral side wall 106 fits snugly within second end 32 of cylindrical shell 26 such that outer wall 104 forms an end of housing 14.

The second end 120 of spiral side wall 106 angles inwardly to form a wedge-shape (see FIG. 17). Second end 120 of spiral flange 106 has a slot 121 therein adjacent inner wall 102 of end cap 22.

Spiral side wall 106 also includes buttons 114 protruding outwardly therefrom, spaced approximately 180° apart. Buttons 114 are located and are of a size to be received in a pair of holes 42 in cylindrical shell 26 to connect plug 101 to cylindrical shell 26.

Plug 112 extends outwardly from inner wall 102, is cylindrical and is received within hole 64 of rotor 16 when magazine 10 is properly assembled.

Loading assembly 24, as illustrated in FIGS. 1 and 14–16, includes body 140, spring 142 and first end cap 144. Loading assembly 24 is coupled to first end 30 of cylindrical shell 26 so that body 140 is pivotable 90° between a first unloaded position 146, as illustrated in FIG. 2, and a second loaded position 148, as illustrated in FIG. 3.

Body 140 includes head 150, middle portion 153, arms 152 and legs 151. Head 150 extends outwardly from middle portion 153 beyond first end 30 of cylindrical shell 26 when magazine 10 is properly extended and can be grasped to pivot loading member body 140 between its unloaded and loading positions 146 and 148, respectively. Legs 151 extend outwardly from middle portion 153. Each leg 151 includes shelf 155 and retaining dog 154. Legs 151 together form a cylinder with side slots for resiliency. Slotted bore 156 is formed between legs 151.

Legs 151, when magazine 10 is properly assembled, extend into first end 30 of cylindrical shell 26 and are rotatably received within hole 78 of ratchet member 18 via a snap-fit. Slotted bore 156 receives shaft 62 of carrier 16 and spring 142.

Arms 152 extend outwardly from middle portion 153 and perpendicularly to longitudinal axis 34 and are spaced apart from head 150.

Spring or biasing member 142 is preferably a common coil spring. Spring 142 is received within slotted bore 156 formed by legs 151, and spring 142 itself receives shaft 62 of carrier 16.

First end cap 144 includes end wall 157, collars 160 and buttons 162. First end cap 144 is coupled to first end 30 of cylindrical shell 26.

End wall 157 is substantially the same diameter as cylindrical shell 26 and has slot 150 therein. Collars 160 have substantially the same diameter as the interior of cylindrical shell 26 so that first end cap 144 fits snugly within first end 30 of cylindrical shell 26. End cap slot 158 extends through end cap face 157 and receives loading member body 140 therethrough. End cap slot 158 is designed such that arms 152 of loading member 24 will fit through slot 158 when arms 152 are substantially in alignment with slot 158, but will not fit through slot 158 when out of alignment with slot 158. In first unloaded position 146, i.e., when arms 152 are in alignment with slot 158, arms 152 of loading member body 140 are biased through end cap slot 158 by spring 142 acting on carrier 16. In the second loaded position 148, arm 152 of loading member body 140 extends perpendicularly to end cap slot 158 thereby locking ratchet member 18 in engagement with carrier 16.

Buttons 162 extend from end cap face 157 and snap-fit into holes 42 at first end 30 of cylindrical shell 26 to couple first end cap 144 to cylindrical shell 26.

Assembly and Operation

To assemble magazine 10, spring 142 is inserted into slotted bore 156 formed by legs 151 of loading member body 140, and legs 151 are inserted through center hole 85 of ratchet 18 and coupled via snap-fit to ratchet 18. More specifically, legs 151 resiliently bias inwardly until they fit through center hole 85. Legs 151 bias outwardly after dogs 154 pass through center hole 85 of ratchet 18, such that dogs 154 and shelf 155 couple ratchet 18 to legs 151. Ratchet 18 is rotatably coupled to legs 151.

Rotor 16 is inserted through second end 32 of cylindrical shell 26. Shaft 62 of rotor 16 is then inserted into slotted bore 156 and spring 142. Ratchet 18 is oriented so that pin bore 80 is aligned with L-shaped slot 38 in cylindrical shell 26. First end cap 144 is then coupled to first end 30 of cylindrical shell 26 with head 140 of loading member 24 extending through slot 158 in first end cap 144. Specifically, buttons 162 are aligned with holes 42 at first end 30 of cylindrical shell 26 and couple end cap 144 to first end 30 via a snap-fit.

At second end 32 of cylindrical shell, end cap 22 is coupled thereto via a snap-fit also. Specifically, buttons 114 snap into holes 42 at second end 32 to couple end cap 22 to second end 32. Plug 112 of end plug 101 is received in hole 64 of carrier 16. Arms 66 of flutes 60 are positioned adjacent second end 32 of cylindrical shell 26 and cap assembly 22. End point 124 of feeding groove 108 of plug 101 is in alignment with cutout 40 of housing 14.

Finally, one end of pivot pin 86 is pressed into pivot pin bore 80 of ratchet 18 through L-shaped slot 38 of housing 14.

The loading of magazine 10 with pellets 12 is illustrated in FIG. 2. Loading member body 140 is positioned such that arms 152 are in alignment with end cap slot 158. In this position, spring 142, which has one end in abutment with carrier 16, forces loading assembly body 140 outwardly to its outermost position, position 146, as illustrated in FIG. 2. In this position, the top of legs 151 abut the area of end cap 144 immediately adjacent slot 158 (because the top of legs 151 will not fit through slot 158) and prevent further outward movement of loading assembly 24. When loading member body 140 is in outermost position 146, ratchet 18 is disengaged from carrier 16 and pin 86 is located in first leg 48 of L-shaped slot 38. When ratchet 18 is disengaged from carrier 16, carrier 16 rotates freely within cylindrical shell 26 since outer edge surfaces 83 of ratchet 18 are not in engagement with flutes 60 of carrier 16 or bulkheads 45 of housing 14.

Pellets 12 are then loaded through cut-out 40 at second end 32 of housing 14 between each flute 60 as desired. Carrier 16 can be rotated such that all of the valleys between adjacent flutes 60 can be filled with pellets 16, i.e., each valley is in alignment with slot 40.

Once magazine 10 is loaded with pellets 12, loading member body 140 is forced inwardly to innermost position 148 and pivoted 90°, as illustrated in FIG. 3. During this movement of loading member body 140, end cap wall 157 is received between arms 152 and head 158 of loading member body 140 to lock loading member body 140. Pin 86 is moved into first end or intersection 50 of second leg 48 of L-shaped slot 38.

Before inserting pin 86 of magazine 10 into camming bolt 20, ratchet 18 must be pre-set. This is done by manually moving pin 86 from first end 50 of second leg 48 to second end 52 of second leg 48. As pin 86 is moved, ratchet 18 rotates in its second direction 71 (see FIG. 1). Pin 86 is then inserted into first end portion 92 of cam groove 90 of camming bolt 20 with camming bolt 20 in its first position 98. Outer edge portions 83 of enlarged heads 78 of lug members 74 are in engagement with two notches 67 of diametrically opposed flutes 60.

In operation, camming bolt 20 starts in first position 98 with pin 86 received in first end portion 92 of cam groove 90, as stated. When the gun to which magazine 10 is attached is activated, camming bolt 20 is moved from its first position 98 to its second position 99. This action moves groove 90 relative pivot pin 86 such that pivot pin 86 moves from being received in first end portion 92 to being received in second end portion 96, passing through angled portion 94. Since camming bolt 20 is limited to linear reciprocal movement, this movement of camming bolt 20 relative to pin 86 causes pin 86 to rotate in an arc around longitudinal axis 34. Since cylindrical shell 26 is stationery, this movement results in pin 86 moving from second end 52 of second leg 48 of L-shaped slot 38 to first end 50 of leg 48. Center angled portion 94 cams pivot pin 86. Since pin 86 is affixed to ratchet 18, this action of pin 86 rotates ratchet 18 in first direction 73, as illustrated in FIG. 1. When ratchet 18 rotates in first direction 73, inner edge portions 79 of enlarged heads 78, which are in engagement with two notches 67 in flutes 60, push or rotate these flutes, and thus rotor 16, with ratchet 18. Rotor 16 is preferably rotated a distance substantially equal to the diameter of one pellet 12.

Additionally, as rotor 16 rotates, pellets 12 are driven along carrier 16 by spiral 36 of housing 14. One pellet 12 is guided by a flute 60, spiral side wall 106 of plug 101 and feeding groove 108 of plug 101 out of magazine 10 through cut-out 40 of housing 14 and into the gun to which magazine 10 is attached.

Figure 4:
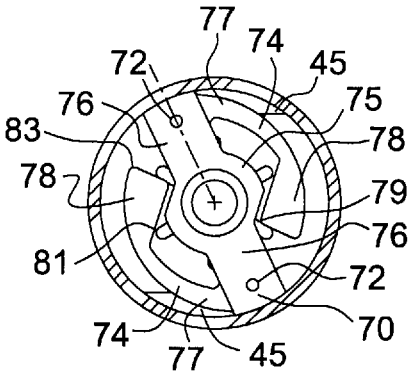
FIG. 4 is a transverse cross-sectional view of the magazine of FIGS. 1–3 along line C—C of FIG. 3, illustrating the ratchet and rotor assembly in its first position.
Figure 4A:
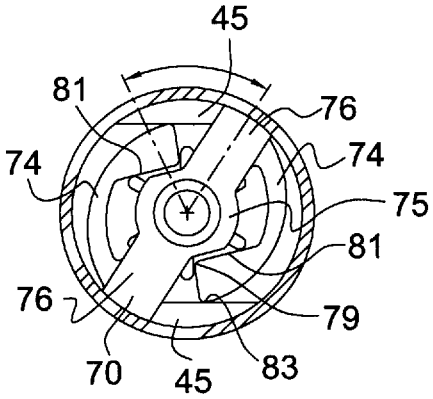
FIG. 4*a* is a transverse cross-sectional view of the magazine of FIGS. 1–3 along line C—C of FIG. 3, illustrating the ratchet and rotor assembly in its second position.
Figure 5:
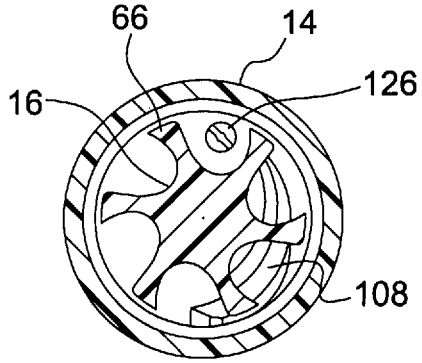
FIG. 5 is a transverse cross-sectional of the magazine of FIGS. 1–3 along line B—B of FIG. 3.
Figure 6:
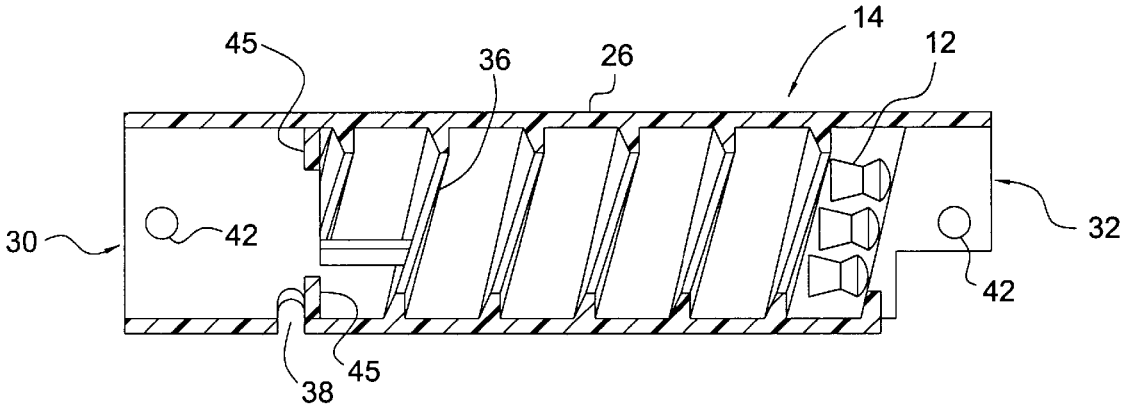
FIG. 6 is a longitudinal cross-sectional view of the cylindrical shell of the housing of the magazine of FIGS. 1–5 with sample pellets added for clarity.

At the end of the rotational stroke, outer edge portions 83 of enlarged heads 78 engage bulkheads 45. Bulkheads 45 force enlarged heads 78 inwardly. The next flutes 60 in the rotational direction 73 engage inner surfaces 81 of enlarged heads 78, thus stopping the rotation of rotor 16 (see FIG. 4*a*).

When camming bolt 20 is moved from its second position 99 back to its first position 98, camming bolt 20 moves relative pin 86 such that pin 86 moves from second end portion 96 to first end portion 92, through angled portion 94. This action rotates pin 86 in an arc around longitudinal axis 34. Pin 86 moves, in second leg 48 of L-shaped slot 38, from the first end 50 to the second end 52. This rotational movement of pin 86 also simultaneously rotates cross arm 70 of ratchet 18 in second direction 71 as seen in FIG. 1. When ratchet 18 is rotated in second direction 71, the centrifugal force on lug members 74 urges lug members 74 outward, such that the outer edge portions 83 of enlarged heads 78 abut and slide along the interior surface of cylindrical shell 26. As enlarged heads 78 slide along the interior surface of cylindrical shell 26, inner surfaces 81 clear the next flute without touching the flute, such that rotor 16 remains stationary. When this rotation ceases, lug members 74 are pushed inwardly by bulkheads 45, such that inner edge portions 79 engage with notches 67 of the next flutes 60.

This process can be repeated, and another pellet discharged from the magazine 10 to the gun, until magazine 10 is emptied of pellets 12. Then magazine 10 may be reloaded with pellets 12, as set forth above as desired.

Various modifications, improvements and other embodiments will become apparent to those skilled in the art once given this disclosure. Such modifications, improvement and other embodiments are considered to be within the scope of this invention as defined by the following claims.

What is claimed is:

1. A rotor and ratchet assembly comprising a housing, a rotor and a ratchet member;

said rotor being rotatably located within said housing;

said ratchet member being rotatably located within said housing, said ratchet member including at least one locking lug, said ratchet member being rotatable between first and second positions relative said housing;

said locking lug engaging said rotor when said locking lug is rotated in a first direction from said first position to said second position and causing said rotor to rotate with said locking lug;

said locking lug engaging said housing when said ratchet member is in said second position, said housing maintaining said ratchet member in engagement with said rotor when said ratchet member is in said second position in a manner to stop rotation of said rotor;

said locking lug disengaging said rotor when said ratchet member is rotated in a second direction from said second position to said first position.

2. A rotor and ratchet assembly according to claim 1, wherein said ratchet member also includes a cross member, said locking lug being rotatably attached to said cross member.

3. A rotor and ratchet assembly according to claim 2, wherein said cross member is an elongated member;

said locking lug is rotatably attached to one end of said cross member.

4. A rotor and ratchet assembly according to claim 3, wherein said locking lug includes a head portion which engages the housing and the rotor;

said head portion having an outer edge portion which engages the housing and an inner edge portion which engages the rotor.

5. A rotor and ratchet assembly according to claim 4, wherein said locking lug also includes an elongated arm portion, said arm portion having two ends, a first of said ends being rotatably attached to said cross member, said head portion being located at a second of said ends.

6. A rotor and ratchet assembly according to claim 5, wherein said rotor includes a plurality of parallel flutes;

said flutes being engaged by said locking lug.

7. A rotor and ratchet assembly according to claim 6, wherein said rotor is substantially cylindrical.

8. A rotor and ratchet assembly according to claim 7, wherein said flutes have notches which are engaged by the inner edge portion of said locking lug.

9. A rotor and ratchet assembly according to claim 8, wherein said rotor includes a cylindrical core;

said flutes extend outwardly from said cylindrical core;

said notches being formed in the base of said flutes with said cylindrical core.

10. A rotor and ratchet assembly according to claim 9, wherein said head portion has a larger depth and width than said arm portion.

11. A rotor and ratchet assembly according to claim 10, wherein said ratchet member and rotor are rotatable around the same axis;

said locking lug engages one of said notches in one of the flutes to rotate the rotor with the ratchet member;

said head portion including an inner surface adjacent said inner edge portion;

said next adjacent flute engaging said inner surface of the head portion to stop said rotor when said ratchet member is stopped.

12. A rotor and ratchet assembly according to claim 11, wherein said housing includes a bulkhead, said bulkhead extending inwardly into said housing, said head portion engaging said bulkhead when said locking lug is in said second position.

13. A rotor and ratchet assembly according to claim 12, wherein said housing is an elongated member having an interior space;

said rotor and said ratchet member being located within said interior space;

said bulkhead extends from the inner wall of said housing into said inner space.

14. A rotor and ratchet assembly according to claim 13, wherein said head portion and said arm portion are of a width and located such that said head portion engages said bulkhead, but said arm portion does not engage said bulkhead.

15. A rotor and ratchet assembly according to claim 14 wherein said ratchet member includes two locking lugs diametrically opposed;

said housing has two bulkheads which engage said two locking lugs.

16. A rotor and ratchet assembly according to claim 1, wherein said housing is an elongated housing having an elongated center space;

said rotor and said ratchet member being located within said center space and being rotatable around the same axis of rotation within said center space;

said rotor having a plurality of evenly spaced flutes;

said ratchet member including an elongated cross member and a locking lug, said locking lug being rotatably attached to said cross member;

said ratchet member being located adjacent the rotor;

said locking lug having an outer edge portion, an inner edge portion and an inside surface;

said inner edge portion engaging one of said flutes when said ratchet member is rotated in said first direction to rotate said rotor with said ratchet member;

said outer edge portion engaging said housing when said ratchet member is in the second position; and one of said flutes engaging the inside surface of the locking lug when said ratchet member is in the second position to stop said rotor.

17. A rotor and ratchet assembly according to claim 16, wherein said locking lug includes an elongated arm portion and a head portion, said arm portion has two ends, a first of said ends being rotatably attached to said cross member, said head portion being located at a second of said ends;

said head portion including said outer edge portion, said inner edge portion and said inside surface.

18. A rotor and ratchet assembly according to claim 17, wherein said housing includes a bulkhead, said bulkhead extending inwardly into said housing, said head portion engaging said bulkhead when said locking lug is in said second position.

19. A rotor and ratchet assembly according to claim 18, wherein said head portion and said arm portions are of a width and located such that said head portion engages said bulkhead, but said arm portion does not engage said bulkhead.

20. An indexing magazine for storing and dispensing projectiles to a gun comprising:

a housing having a first end, a second end, a passageway extending from said first end to said second end along a longitudinal axis and a helical element extending at least partially from said first end to said second end into said passageway;

a drive member rotatably coupled within said housing and having a plurality of flutes for guiding the projectiles along said helical member;

a release member coupled to said housing for feeding the projectiles from said housing into the gun;

a ratchet member rotatably located within said housing, said ratchet member including at least one locking lug, said ratchet member being rotatable between first and second positions relative said housing;

said locking lug engaging said drive member when said locking lug is rotated in a first direction from said first position to said second position and causing said drive member to rotate with said locking lug;

said locking lug engaging said housing when said ratchet member is in said second position, said housing forcing said locking lug into engagement with said drive member when said ratchet member is in said second position in a manner to stop rotation of said drive member;

said locking lug disengaging said housing and said drive member when said ratchet member is rotated in a second direction from said second position to said first position; and a camming member coupled to said ratchet member to rotate said ratchet member between said first and second positions.

21. An indexing magazine according to claim 20, wherein said ratchet member also includes a cross member, said locking lug being rotatably attached to said cross member.

22. An indexing magazine according to claim 21, wherein said cross member is an elongated member;

said locking lug is rotatably attached to one end of said cross member.

23. An indexing magazine according to claim 22, wherein said locking lug includes a head portion which engages the housing and the rotor;

said head portion having an outer edge portion which engages the housing and an inner edge portion which engages the rotor.

24. An indexing magazine according to claim 23, wherein said locking lug also includes an elongated arm portion, said arm portion having two ends, a first of said ends being rotatably attached to said cross member, said head portion being located at a second of said ends.

25. An indexing magazine according to claim 24, wherein said rotor includes a plurality of parallel flutes;

said flutes being engaged by said locking lug.

26. An indexing magazine according to claim 25, wherein said rotor is substantially cylindrical.

27. An indexing magazine according to claim 26, wherein said flutes have notches which are engaged by the inner edge portion of said locking lug.

28. An indexing magazine according to claim 27, wherein said rotor includes a cylindrical core;

said flutes extend outwardly from said cylindrical core;

said notches being forced in the base of said flutes with said cylindrical core.

29. An indexing magazine according to claim 28, wherein said head portion has a larger depth and width than said arm portion.

30. An indexing magazine according to claim 29, wherein said ratchet member and rotor are rotatable around the same axis;

said locking lug engages one of said notches in one of the flutes to rotate the rotor with the ratchet member;

said head portion including an inner surface adjacent said inner edge portion;

said next adjacent flute engaging said inner surface of the head portion to stop said rotor when said ratchet member is stopped.

31. An indexing magazine according to claim 30, wherein said housing includes a bulkhead, said bulkhead extending inwardly into said housing, said head portion engaging said bulkhead when said locking lug is in said second position.

32. An indexing magazine according to claim 31, wherein said housing is an elongated member having an interior space;

said rotor and said ratchet member being located within said interior space;

said bulkhead extends from the inner wall of said housing into said inner space.

33. An indexing magazine according to claim 32, wherein said head portion and said arm portion are of a width and located such that said head portion engages said bulkhead, but said arm portion does not engage said bulkhead.

34. An indexing magazine according to claim 33, wherein said ratchet member includes two locking lugs which are diametrically opposed;

said housing has two bulkheads which engage said two locking lugs.

35. A dispensing mechanism for storing and dispensing items comprising:

a housing having an outlet;

a rotor rotatably located within said housing, said rotor being designed to convey the items within said housing to the outlet of the housing;

a ratchet member rotatably located within said housing, said ratchet member including at least one locking lug, said ratchet member being reciprocally rotatable between first and second positions within said housing;

said locking lug engaging said rotor when said locking lug is rotated in a first direction from said first position to said second position and causing said rotor to rotate with said locking lug;

said locking lug engaging said housing when said ratchet member is in said second position, said housing maintaining said locking lug in engagement with said rotor when said ratchet member is in said second position in a manner to stop rotation of said rotor;

said locking lug disengaging said bulkhead and said rotor when said ratchet is rotated in a second direction from said second position to said first position; and a drive member to reciprocally rotate said ratchet member between said first and second positions.

36. A dispensing mechanism according to claim 35, wherein said ratchet member also includes a cross member, said locking lug being rotatably attached to said cross member.

37. A dispensing mechanism according to claim 36, wherein said cross member is an elongated member;

said locking lug is rotatably attached to one end of said cross member.

38. A dispensing mechanism according to claim 37, wherein said locking lug includes a head portion which engages the housing and the rotor;

said head portion having an outer edge portion which engages the housing and an inner edge portion which engages the rotor.

39. A dispensing mechanism according to claim 38, wherein said locking lug also includes an elongated arm portion, said arm portion having two ends, a first of said ends being rotatably attached to said cross member, said head portion being located at a second of said ends.

40. A dispensing mechanism according to claim 39, wherein said rotor includes a plurality of parallel flutes;

said flutes being engaged by said locking lug.

41. A dispensing mechanism according to claim 40, wherein said rotor is substantially cylindrical.

42. A dispensing mechanism according to claim 41, wherein said flutes have notches which are engaged by the inner edge portion of said locking lug.

43. A dispensing mechanism according to claim 42, wherein said rotor includes a cylindrical core;

said flutes extend outwardly from said cylindrical core;

said notches being formed in the base of said flutes with said cylindrical core.

44. A dispensing mechanism according to claim 43, wherein said head portion has a larger depth and width than said arm portion.

45. A dispensing mechanism according to claim 44, wherein said ratchet member and rotor are rotatable around the same axis;

wherein said locking lug engages one of said notches in one of the flutes to rotate the rotor with the ratchet member;

said head portion including an inner surface adjacent said inner edge portion;

said next adjacent flute engaging said inner surface of the head portion to stop said rotor when said ratchet member is stopped.

46. A dispensing mechanism according to claim 45, wherein said housing includes a bulkhead, said bulkhead extending inwardly into said housing, said head portion engaging said bulkhead when said locking lug is in said second position.

47. A dispensing mechanism according to claim 46, wherein said housing is an elongated member having an interior space;

said rotor and said ratchet member being located within said interior space;

said bulkhead extends from the inner wall of said housing into said inner space.

48. A dispensing mechanism according to claim 47, wherein said head portion and said arm portions are of a width and located such that said head portion engages said bulkhead, but said arm portion does not engage said bulkhead.

49. A dispensing mechanism according to claim 48, wherein said ratchet member includes two locking lugs diametrically opposed;

said housing has two bulkheads which engage said two locking lugs.

* * * * *